US011497983B2

(12) United States Patent
Irwin, Jr. et al.

(10) Patent No.: US 11,497,983 B2
(45) **Date of Patent: *Nov. 15, 2022**

(54) SECURITY-ENHANCED INSTANT TICKETS VIA HOMOGENEOUS UTILIZATION OF TICKET BACKING AND VARIABLE INDICIA INKS OR DYES

(71) Applicant: Hydragraphix LLC, New York, NY (US)

(72) Inventors: Kenneth E. Irwin, Jr., Dawsonville, GA (US); Fred W. Finnerty, Dawsonville, GA (US)

(73) Assignee: Hydragraphix, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/249,572

(22) Filed: Jan. 16, 2019

(65) Prior Publication Data

US 2019/0151749 A1 May 23, 2019

Related U.S. Application Data

(63) Continuation of application No. 15/189,483, filed on Jun. 22, 2016, now Pat. No. 10,183,213.

(Continued)

(51) Int. Cl.
*B42D 25/27* (2014.01)
*A63F 3/06* (2006.01)

(Continued)

(52) U.S. Cl.
CPC ..... *A63F 3/0665* (2013.01); *A63F 3/065* (2013.01); *A63F 3/0655* (2013.01); *B41J 2/01* (2013.01);

(Continued)

(58) Field of Classification Search
CPC ..... B42D 25/27; A63F 3/065; A63F 3/0665; A63F 3/0655; A63F 2003/066
See application file for complete search history.

(56) References Cited

U.S. PATENT DOCUMENTS 4,241,942 A 12/1980 Bachman
4,540,628 A 9/1985 Oberdeck et al.

(Continued)

FOREIGN PATENT DOCUMENTS

CA 2015351 A1 10/1991
CA 2079553 A1 3/1994

(Continued)

OTHER PUBLICATIONS

Inkpal: Dye Inks vs. Pigment Inks http://www.inkpal.com/ink-news/what-is-the-difference-between-dye-and-pigment-ink/ (Year: 2012).*

(Continued)

*Primary Examiner* — Kyle R Grabowski
(74) *Attorney, Agent, or Firm* — Neal, Gerber & Eisenberg LLP

(57) ABSTRACT

A security-enhanced document includes a substrate and variable indicia comprising ink having a signal. The variable indicia is of a specific type and is applied to the substrate using a specific application technique. At least one other printed portion, which is a back of the document, has background ink noise, and the type of ink of the back of the document is of the same type of ink applied to the substrate using the same application technique as the ink of the variable indicia. The document also includes a scratch-off-coating applied over the variable indicia. The document has a signal-to-noise ratio of the ink of the variable indicia relative to the background ink noise of the back of the document that is not appreciable, thereby making the vari- (Continued)

able indicia unreadable with reference to the back of the document when the scratch-off-coating remains intact.

6 Claims, 5 Drawing Sheets

Related U.S. Application Data

(60) Provisional application No. 62/286,713, filed on Jan. 25, 2016.

(51) Int. Cl.

| | |
|---|---|
| ***B41M 3/00*** | (2006.01) |
| ***B42D 15/02*** | (2006.01) |
| ***B42D 25/20*** | (2014.01) |
| ***B41J 2/01*** | (2006.01) |
| ***B41J 2/32*** | (2006.01) |
| ***B41J 3/01*** | (2006.01) |
| ***G03G 15/00*** | (2006.01) |

(52) U.S. Cl.

CPC . *B41J 2/32* (2013.01); *B41J 3/01* (2013.01); *B41M 3/005* (2013.01); *B42D 15/025* (2013.01); *B42D 25/27* (2014.10); *B42D 25/285* (2014.10); *G03G 15/00* (2013.01); *A63F 2003/066* (2013.01); *A63F 2250/58* (2013.01)

(56) References Cited

U.S. PATENT DOCUMENTS

| | | | |
|---|---|---|---|
| 4,586,711 | A | 5/1986 | Winters et al. |
| 5,213,664 | A | 5/1993 | Hansell |
| 5,414,262 | A | 5/1995 | Filo |
| 5,431,452 | A | 7/1995 | Chang et al. |
| 5,542,710 | A | 8/1996 | Silverschotz et al. |
| 5,569,142 | A | 10/1996 | Snellman |
| 5,569,512 | A | 10/1996 | Brawner et al. |
| 5,704,647 | A | 1/1998 | Desbiens |
| 5,740,514 | A | 4/1998 | Natsudaira |
| 5,772,510 | A | 6/1998 | Roberts |
| 5,803,504 | A | 9/1998 | Deshiens et al. |
| 6,155,491 | A | 12/2000 | Dueker et al. |
| 6,916,047 | B2 | 7/2005 | Jarvis et al. |
| 6,939,627 | B2 | 9/2005 | Morizumi et al. |
| 7,311,599 | B2 | 12/2007 | Knapp |
| 7,322,529 | B2 | 1/2008 | Behm et al. |
| 7,377,512 | B2 | 5/2008 | Brickwood et al. |
| 7,455,323 | B2 | 11/2008 | Taylor et al. |
| 7,472,926 | B2 | 1/2009 | Friesen et al. |
| 7,562,626 | B2 | 7/2009 | Morizumi et al. |
| 7,665,732 | B2 | 2/2010 | Stephens |
| 7,712,741 | B2 | 5/2010 | Lambert |
| 7,720,421 | B2 | 5/2010 | Snyder |
| 8,074,570 | B2 | 12/2011 | Grotkowski et al. |
| 8,342,576 | B2 | 1/2013 | Eschbach et al. |
| 8,366,153 | B2 | 2/2013 | Martineck, Sr. |
| 8,883,390 | B1 | 11/2014 | Tyagi et al. |
| 10,147,283 | B2 | 12/2018 | Weil et al. |
| 10,185,522 | B2 | 1/2019 | Irwin et al. |
| 10,543,712 | B2 | 1/2020 | Behm et al. |
| 2006/0081710 | A1 | 4/2006 | Streeter |
| 2006/0165997 | A1 | 7/2006 | Tevis et al. |
| 2007/0164559 | A1* | 7/2007 | Kozdras ..... A63F 3/0655 283/100 |
| 2007/0281224 | A1 | 12/2007 | Kirk et al. |
| 2008/0138641 | A1* | 6/2008 | Leenders ..... B42D 25/415 428/545 |
| 2008/0197621 | A1* | 8/2008 | Grotkowski ..... A63F 3/065 283/94 |
| 2009/0263583 | A1 | 10/2009 | Mantell et al. |
| 2010/0218693 | A1 | 9/2010 | Kozdras |
| 2010/0253063 | A1 | 10/2010 | Skogster |
| 2011/0001314 | A1 | 1/2011 | Eschbach et al. |
| 2012/0025516 | A1* | 2/2012 | Miller ..... A63F 3/0655 283/100 |
| 2012/0267888 | A1* | 10/2012 | Behm ..... A63F 3/0665 283/100 |
| 2014/0356537 | A1 | 12/2014 | Tyagi et al. |
| 2017/0236371 | A1 | 8/2017 | Froelich et al. |

FOREIGN PATENT DOCUMENTS

| | | | |
|---|---|---|---|
| CA | 2359581 | A1 | 1/2002 |
| CA | 2421241 | A1 | 8/2003 |
| CN | 101883680 | A | 11/2010 |
| EP | 0608065 | A2 | 7/1994 |
| JP | 2001331770 | A | 11/2001 |
| WO | 9535216 | A1 | 12/1995 |
| WO | 2010130041 | A1 | 11/2010 |

OTHER PUBLICATIONS

Instant Lottery Ticket, Madehow.com, vol. 4, downloaded from webpage: <http://www.madehow.com/Volume-4/instant-Lottery-Ticket.html>.

Int'l Search Report dated Apr. 7, 2017 in Int'l Application No. PCT/US2017/014933.

Written Opinion dated Feb. 22, 2018 in International Application No. PCT/US2017/014933.

Int'l Preliminary Report on Patentability dated May 17, 2018 in Int'l Application No. PCT/US2017/014933.

"Extended European Search Report", European Patent Application No. 20 16 5567 (7 pages), dated Aug. 21, 2020.

"First Chinese Office Action", corresponding Chinese Patent Application No. 2017800197581, dated Aug. 23, 2021.

"First Chinese Office Action and Search Report—English Translation", corresponding Chinese Patent Application No. 2017800197581, dated Aug. 23, 2021.

* cited by examiner

SECURITY-ENHANCED INSTANT TICKETS VIA HOMOGENEOUS UTILIZATION OF TICKET BACKING AND VARIABLE INDICIA INKS OR DYES

CROSS-REFERENCE TO RELATED APPLICATION

This application is a continuation of copending U.S. patent application Ser. No. 15/189,483, filed Jun. 22, 2016, which is incorporated by reference herein.

This application claims the benefit of U.S. Patent Application No. 62/286,713, filed Jan. 25, 2016.

FIELD OF THE INVENTION

The present invention relates generally to documents, such as lottery tickets, having variable indicia under a Scratch-Off-Coating (SOC), and more particularly to methods for enhancing the security of the documents while adding to the aesthetics of the documents.

BACKGROUND

Lottery scratch-off or instant games have become a time-honored method of raising revenue for state and federal governments the world over. Indeed, the concept of hiding variable indicia information under a SOC has also been applied to numerous other products such as commercial contests, telephone card account numbers, gift cards, etc. The variable indicia are the letters, numbers, images or other indicia which determine whether a ticket is a winner typically by identically matching two or more of the particular letters, numbers, images or other indicia that are part of the variable indicia under the SOC. Literally, billions of scratch-off products are printed every year where the SOCs are used to ensure that the product has not been previously used, played, or modified.

Typically the variable indicia are printed using a specialized high-speed ink jet with a water-soluble dye imaged on top of display printed (e.g., flexographic, gravure, etc.) security layers that provide opacity, chemical barriers, and a higher contrast background for the ink jet variable indicia. The purpose is to ensure that the printed variable indicia cannot be read or decoded without first removing the associated SOC, thereby ensuring that a game or product is secure against picking out winners or extracting confidential information from unsold tickets or documents.

However, there are known methods (e.g., wicking, vapor, steam, alcohol soaks, etc.) for diffusing the ink jet variable indicia either through the substrate backing or the front SOC. When carefully applied, these methods can temporally reveal the previously hidden variable indicia, thereby enabling illicit people to determine if a given ticket is a winner or non-winner while leaving little or no trace and thereby only selling losing tickets to the public. The pick-out of winning variable indicia is made possible by a positive Signal-to-Noise (S/N) ratio of the diffused ink jet image through the substrate of SOC relative to the ticket's background ink noise.

In addition to diffusion, techniques have been developed for inducing fluorescence in the ink jet variable indicia dye. In these fluorescence attacks the dye is made to fluoresce with the ticket background not emitting any light or no light in the same wavelength as the fluorescing variable indicia ink jet image. Since the variable indicia emits fluorescent light in a wavelength different from the excitation source and the ticket background, there is a relatively high S/N ratio established between the fluorescence emissions of the variable indicia and the ticket's excitation light background. This relatively high S/N ratio allows for filtered (i.e., using a narrow band optical filter only allowing fluorescent wavelength light to pass) timed exposures with digital cameras that can successfully capture variable indicia images through an intact SOC that are not discernable by the human eye. This again allows for illicit pick-out of winning tickets with only losing tickets being sold to an unsuspecting public.

Similar to the above diffusion and fluorescence techniques, electrostatic charges have also been applied to instant tickets with intact SOCs creating a differential charge in the hidden ink jet variable indicia. At this point if an electrostatically sensitive powder (e.g., baby powder) is applied over the SOC, the powder will align in the two-dimensional shape of the (previously) hidden variable indicia yet again allowing for the underlying variable indicia to be viewed over an intact SOC and allowing winning tickets to be picked-out. When the charge is removed and the powder brushed away, no indication remains that the ticket's integrity was compromised. The electrostatic attack is based on establishing a positive S/N ratio of the ink jet variable indicia's charge relative to the ticket's background ink noise.

All of these variable indicia compromise practices have been mitigated with elaborate countermeasures meticulously developed in the instant ticket industry over decades. Most of these countermeasures rely on various printed (via a fixed plate—i.e., non-variable) chemical barriers to resist the aforementioned attacks. The general concept is to secure the variable ink jet indicia image and chemistry with the chemical barrier layer(s) reducing the variable indicia's S/N ratio to near unity or below relative to the ticket's background unless the SOC has been removed. However, these added barrier security layers have the disadvantage of added costs, reduced aesthetics, intermittent failures, as well as laborious testing and verification.

Additionally, there are known techniques for mechanically "lifting" the SOC and thereby viewing the variable indicia. The term "mechanical lift" refers to a process that uses a flat blade (e.g., X-Acto chisel blade #17) or other device to peel back a portion of the SOC to reveal previously hidden variable indicia. The lifted SOC is then glued back into place such that it is not obvious that the integrity of the coating has been breached. The industry has developed countermeasures to the previously described mechanical lift technique which involve changing the formulation of the SOC so that it is more difficult to remove and/or it flakes off or crumbles, rather than peeling off in one piece, thereby making "unassisted" SOC lifts more difficult. However, these techniques have done nothing to alleviate the vexing problem of "assisted" SOC lifts. Assisted lifts differ from unassisted lifts in that another medium or material is applied to the SOC (e.g., Krylon® acrylic clear spray) to strengthen it, thereby assisting anyone who is attempting a mechanical lift.

It is therefore highly desirable to develop techniques and methodologies for ensuring the security and integrity of scratch-off tickets and documents that is less reliant on chemical barrier technology attenuating the variable indicia's S/N ratio under special (i.e., predefined attack) circumstances, offering a more robust and generic defense. Ideally, these more generic defense mechanisms would also provide added security against mechanical SOC lifts, both unassisted and assisted. Particularly, these security techniques should enhance the aesthetics of the ticket or document rather than detracting from its appearance.

SUMMARY OF THE INVENTION

Objects and advantages of the invention will be set forth in part in the following description, or may be apparent from this description, or may be learned through practice of the invention.

The invention relates to a security-enhanced document with a removable SOC, which may be an instant lottery ticket in certain embodiments. The document includes any manner of suitable substrate, with the variable indicia remaining unreadable via diffusion, fluorescence, pick-off or electrostatic attacks until the associated SOC layer is legitimately removed.

A first aspect relates to a security-enhanced document comprising a substrate, variable indicia, at least one other printed portion having background noise, and a SOC layer applied over the variable indicia to maintain the variable indicia unreadable until the SOC is removed by being scratched off, the variable indicia comprising ink having a S/N ratio relative to the background ink noise of the document's at least one other printed portion, such that the variable indicia are unreadable with reference to the at least one other printed portion when the SOC remains intact.

In a second aspect of the document as mentioned in the first aspect above, the at least one other printed comprises a display area.

In a third aspect of the document as in the second aspect, the ink for the variable indicia and the display area is a dye based ink.

In a fourth aspect of the document as in the third aspect, the ink for the variable indicia and the display area is a pigment based ink.

In a fifth aspect of the document as in the first aspect, the at least one other printed portion comprises an overprint area.

In a sixth aspect of the document as in the fifth aspect, the ink for the variable indicia and the overprint area is a dye based ink.

In a seventh aspect of the document as in the fifth aspect, the ink for the variable indicia and the overprint area is a pigment based ink.

In an eighth aspect of the document as in the first aspect, the at least one other printed portion comprises a back printing area.

In a ninth aspect, the document as in the eighth aspect, the ink for the variable indicia and back printing area is a dye based ink.

In a tenth aspect of the document as in the eighth aspect, the ink for the variable indicia and the back printing area is a pigment based ink.

In an eleventh aspect of the document as in the first aspect, the document further comprises at least two other printed portions selected from the group consisting of at least one display area, at least one overprint area and at least one back printing area, that is at least one display area, at least one overprint area or at least one back printing area, or combinations thereof.

In a twelfth aspect of the document as in the eleventh aspect, the ink for the variable indicia and at least one of the at least two other printed portions is a dye based ink.

In a thirteenth aspect of the document as in the eleventh aspect, the ink for the variable indicia and at least one of the at least two other printed portions is a pigment based ink.

In a fourteenth aspect of the document as in the first aspect, the document further comprises at least three other printed portions selected from the group consisting of at least one display area, at least one overprint area and at least one back printing area, that is at least one display area, at least one overprint area or at least one back printing area, or combinations thereof.

In a fifteenth aspect of the document as in the fourteenth aspect, the ink for the variable indicia and at least one of the three other printed portions is a dye based ink.

In a sixteenth aspect of the document as in the fourteenth aspect, the ink for the variable indicia and at least one of the three other printed portions is a pigment based ink.

In a seventeenth aspect of the document as in the first aspect, the document further comprises at least two other printed portions selected from the group consisting of at least one display area and at least one overprint area, that is at least one display area or at least one overprint area or both, the overprint area and the display area are imaged as a continuous image, such that any mechanical lifting of the.SOC will result in an observable disruption in the continuous image of the display area and the overprint area.

In an eighteenth aspect of the document as in aspect seventeen, the display area and the overprint area continuous image includes micro printing.

In a nineteenth aspect of the document as in the eighteenth aspect, the micro printing comprises fine lines.

In a twentieth aspect of the document as in the first aspect, the variable indicia are applied directly onto the substrate without an intervening layer.

In a twenty-first aspect of the document as in the first aspect, the variable indicia are applied directly onto an intervening layer of at least one intervening layer applied to the substrate.

The invention also relates to a method for generating a security-enhanced document comprising a substrate, variable indicia, at least one other printed portion having background noise, and a SOC layer applied over the variable indicia to maintain the variable indicia unreadable until the SOC is removed by being scratched off, the method comprising printing the variable indicia comprising ink having a S/N ratio relative to the background ink noise of the document's at least one other printed portion, such that the variable indicia are unreadable with reference to the at least one other printed portion when the SOC remains intact.

In another aspect of the method just mentioned, the variable indicia and the at least one other printed portion are printed with a printing technique selected from the group consisting of ink jet printing, thermal transfer and xerography, that is ink jet printing, thermal transfer or xerography or any combination thereof.

In another aspect of the method just mentioned, the ink is selected from the group consisting of dye based ink and pigment based ink, that is dye based ink or pigment based ink, or both.

In a particular embodiment, the variable indicia is imaged using the same application technique and type of ink as the display portion or area (i.e., decorative portion, not covered by the SOC) of the document providing a common printed foundation for both the display and variable indicia portions, thereby greatly reducing the variable indicia's S/N ratio relative to the ticket's display background so long as the SOC remains intact. Unlike barrier chemistry countermeasures already known in the art, this embodiment has the advantage of reducing the variable indicia's S/N ratio relative to the document's background under virtually any circumstances, rather than only for specified attacks.

In another embodiment, the variable indicia are imaged using the same application technique and type of ink as the overprint portion or area (i.e., decorative portion, printed on top of the SOC) of the document providing common printed films for both the variable indicia and the SOC itself. Again, this greatly reduces the variable indicia's S/N ratio relative to the scratch-off area so long as the SOC remains intact. This embodiment also has the advantage of providing a countermeasure against unassisted and assisted mechanical SOC lifts.

In still another embodiment, the document's backing is imaged, that is has back printing, using the same application technique and type of ink as the variable indicia, reducing the variable indicia's S/N ratio to the document's backing when viewed from the rear. Of course, the common display, overprint, and backing applications relative to the variable indicia can be combined in various manners further reducing the variable indicia's S/N ratio relative to the document's background.

In all of these embodiments, the variable indicia may be imaged on a security ink film layer (e.g., blocking layer for opacity) or imaged directly on the document's substrate (assuming sufficient opacity can be achieved by other means). The essential concept of the invention is to utilize common materials and application techniques for both the document's variable indicia and other portions (i.e., display, overprint, and/or backing areas) so that tampering can be discerned.

Described are a number of printing mechanisms and methodologies that provide practical details for reliably producing secure variable indicia under a SOC that is immune to various pick-out techniques that focus on the differences between the variable indicia and the associated background. Although the examples provided herein are primarily related to instant tickets, it is clear that the same methods are applicable to any type of document (e.g., telephone card) where information is protected by a SOC.

DETAILED DESCRIPTION

Figure 1:
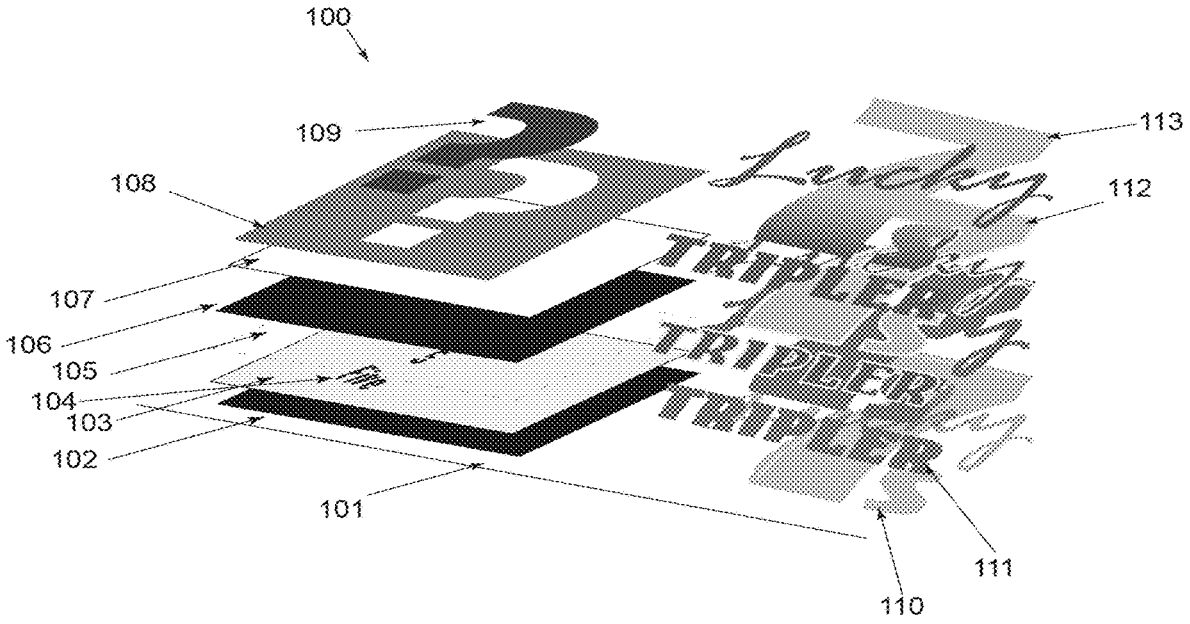
FIG. 1 is an exploded top isometric view of a representative example of a traditional lottery-type instant ticket security ink film stack where the ink jet is applied as a separate process and ink film.

Reference will now be made in detail to examples of the invention, one or more embodiments of which are illustrated in the drawings. Each example is provided by way of explanation of the invention, and not meant as a limitation of the invention. For example, features illustrated or described as part of one embodiment, may be used with another embodiment to yield still a further embodiment. It is intended that the present invention encompasses these and other modifications and variations as come within the scope and spirit of the invention.

A printing method or system for making a security-enhanced scratch-off document and the document so made are disclosed. The security-enhanced document includes a substrate, variable indicia, at least one other printed portion having background noise, and a scratch-off-coating layer applied over the variable indicia to maintain the variable indicia unreadable until the scratch-off-coating is removed by being scratched off. The variable indicia includes ink having a signal-to-noise ratio relative to the background ink noise of the document's at least one other printed portion, such that the variable indicia are unreadable with reference to the at least one other printed portion when the scratch-off-coating remains intact. Additionally, digitally imaging countermeasures to unassisted and assisted mechanical SOC lift are also disclosed. These methods and systems enhance the overall appearance of the ticket as well as potentially reduce the time and setup costs between print runs.

FIG. 1 depicts a representative example of the variable indicia and associated security ink stack typical of a traditional ink jet SOC secured document—i.e., an instant lottery ticket 100. As shown in FIG. 1, the variable printed variable indicia 104 are between lower security ink films 102 and 103 and upper security ink films 105, 106 and 107 in an attempt to provide chemical barriers protecting the variable indicia 104 from diffusion, fluorescence, electrostatic, and other known attacks. The entire ink film stack is deposited on a paper, foil, or other substrate 101. The lower security-ink film layers include layer 102 providing opacity and diffusion barriers, as well as a higher contrast (e.g., white or gray against a black or other dark color) background layer 103, such that a human consumer can read the variable indicia 104. The upper security ink film layers also isolate the variable indicia 104, first with a release coating 105 that helps seal the variable indicia to the substrate 101 and also causes any ink films printed on top of the variable indicia 104 to scratch-off. The SOC comprises one or more layers, and typically several, so that the variable indicia 104 is not visible until the ticket is played by the SOC being legitimately scratched off. The SOC layer of exemplary ticket 100 comprises at least one upper opacity layer 106 is applied to help protect against candling and fluorescence attacks. On top of the opacity layer(s), at least one white ink film 107 is typically applied that provides a higher contrast background for overprint inks. Finally, decorative overprint ink areas or layers 108 and 109 are applied for both an attractive appearance of the SOC area, as well as sometimes providing additional security. In addition to the security ink stack and variable indicia of areas or layers 102 through 109 of ticket 100, the ticket also has printed decorative display area layers 110 through 113 designed to make the ticket 100 more attractive and provide instructions for game play. The printing "layers" mentioned herein may be applied in any form and in any image, and for many of the layers, not edge to edge of the ticket or other document. Thus, "layers" as used herein is equivalent to "areas" or "portions" of printed images or other indicia. Typically, this display area printing is printed via an offset or flexographic (i.e., fixed printing plate) process where the four primary printing colors Cyan 110, Magenta 111, Yellow 112, and blacK 113 (i.e., CMYK) are blended in varying intensity to mimic all colors perceived by a human. However, other printing processes and techniques may be used if desired.

Thus, a large number of security ink film layers (seven in the example of FIG. 1) are required to protect and allow for only legitimate consumer readability of the variable indicia 104 of a traditional SOC protected document, such as an instant lottery ticket. Of course, the example of FIG. 1 is just one possible arrangement of a traditional SOC protected document with security ink films, with the goal of any security ink film coating arrangement being to provide barriers to outside attempts to detect the variable indicia without properly removing the SOC.

These security ink film barriers have been highly evolved to provide security countermeasures against various diffusion, fluorescence, electrostatic, and other attacks as they became known to the industry. Thus, the barriers are highly tuned to known attacks and not necessarily helpful against new attacks that utilize previously unknown agents or excitation wavelengths. The industry typically modifies these highly tuned and complex security barriers only when a new attack becomes known.

Figure 2:
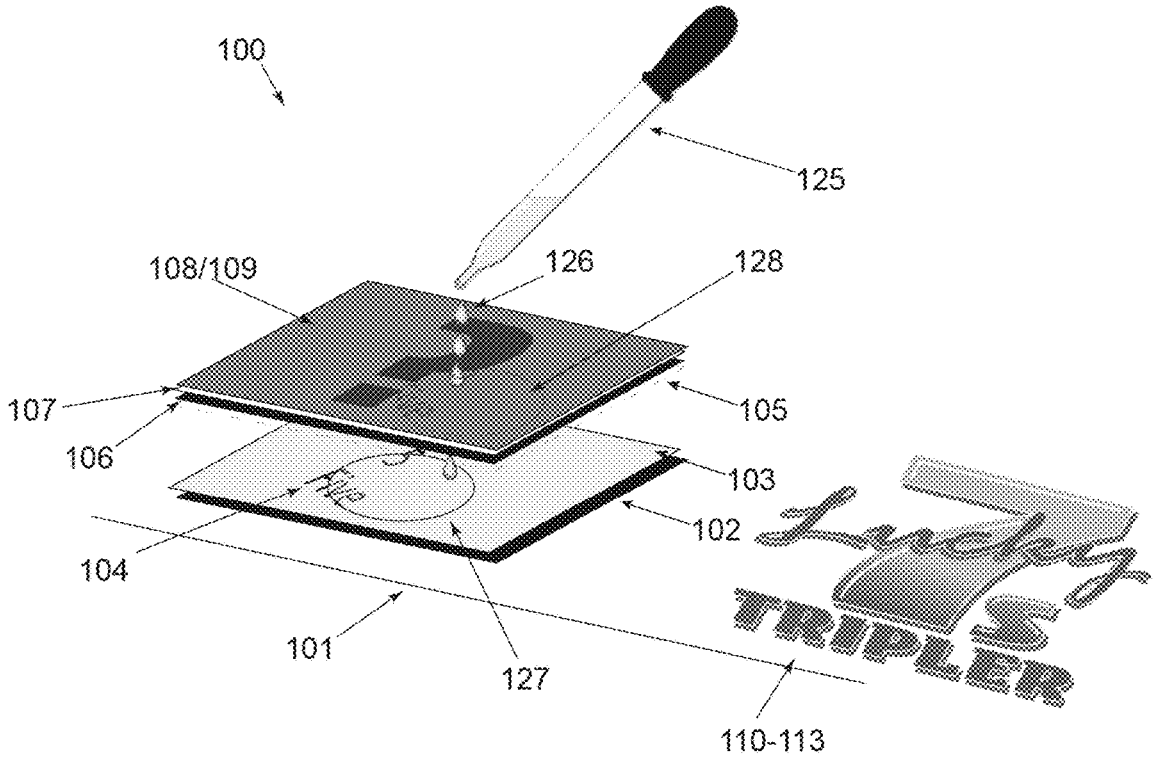
FIG. 2 is an exploded top isometric view of the traditional lottery-type instant ticket security ink film stack of FIG. 1 under a diffusion attack through the overprint layers.

For example, FIG. 2 illustrates a diffusion attack on an instant ticket 100 where a solvent 126 that was selected to attack the chemistry of the ink jet variable indicia 104, such that when the solvent 126 is gently applied by an eye dropper 125, the solvent 126 penetrates through the decorative overprints 108 and 109, the white ink film 107, the upper opacity layer 106, and the release coat 105 without disturbing their chemical bond to the ticket 100, the ink stack (102 through 109), or the substrate 101, thereby allowing those layers to appear intact and undisturbed. If the solvent 126 is properly selected it will saturate an area 127 of the variable indicia 104 and cause a small portion of the variable indicia to diffuse through the upper security layers and the overprints (105 thru 109) to reveal a faint ghost image 128 of the underlying variable indicia 104. As is typical of these types of attacks, once the ticket 100 is allowed to dry, the ghost image 128 disappears leaving virtually no trace that the ticket 100 was compromised for pick-out of the variable indicia 104 via diffusion. This same type of diffusion attack can also be applied to traditional lottery tickets via the back of the substrate 101.

This type of attack relies on the ink jet variable indicia 104 of a traditional lottery ticket 100 being of a separate chemical composition than the upper security ink layers (105 through 109), the lower security ink layers (102 and 103), and the display area print (110 through 113). This works because traditional lottery tickets typically employ an ink jet dye for printing the variable indicia 104 that is of a chemistry that is substantially different than the security ink layers (102 through 103 and 105 through 107), overprint areas 108 and 109, and display areas 110 through 113. This is because the variable indicia 104 are variable from ticket to ticket and the high volumes of scratch-off documents produced in a typical print run require the variable indicia to be printed at high speeds (e.g., 600 to 1,000 Feet Per Minute—FPM) and at as low a cost as possible to be economically feasible. When these considerations are combined with the variable indicia 104 and associated barcode and inventory control number (not shown) being the only variable data printed on a ticket 100, it becomes the accepted state of the art to utilize different chemistry (e.g., water based dye) for the ink jet than the rest of the ticket 100.

Known diffusion attacks (e.g., alcohol) have been mitigated by attempting to make the security barriers impervious to solvents 126 of the ink jet variable indicia 104. The release coat 105 in particular has become of increasingly exotic nature both in terms of chemistry and application. The current state-of-the-art is to cure the release coat with an electron beam in a controlled atmosphere. However, the possibility always remains that a new solvent may be discovered that penetrates these coatings and thereby defeats the existing countermeasures. Alternatively, diffusion attacks may also be attempted in the opposite direction (i.e., through the back of the substrate 101 and the lower security coatings 102 and 103) where the barrier seals may not be as sophisticated due to the high graphic adhesion requirements of the lower security coatings. The significant point is that so long as the materials and application of the ink jet variable indicia 104 remains different than the security ink layers 102 through 103 and 105 through 107, the overprint areas 108 and 109, and the display areas 110 through 113 the possibility always remains to achieve a S/N ratio sufficient to discern the variable indicia 104 via a ghost image 128 without removing the SOC.

The same concept of differing materials and applications for the variable indicia relative to the rest of the document enabling security attacks without removing the SOC can be applied to fluorescence and electrostatic attacks. In the special case of electrostatic attacks, the differential charge in the hidden variable indicia generally can be neutralized using anti-static barriers typically comprising a conducting polymer (plastic) and a solvent made from deionized water and alcohol. When printing, the solvent evaporates, leaving behind an invisibly thin conducting film on the surface of the printed image that shields differential charge build-up, thereby providing a shield against all types of electrostatic attacks. However, since the variable indicia is applied by a different technique and uses different ink than the rest of the document, the possibility still remains that some charge differential may be utilized in the future using an unknown technique (e.g., higher voltage, differing polarity, etc.) that allows for the variable indicia to be read without removal of the SOC.

Fluorescence attacks are another matter; the large numbers of potential excitation wavelengths that may induce fluorescence in differing wavelength(s) are literally in the hundreds of thousands. Also, the long molecular chains of Volatile Organic Compound (VOC) dyes (typical of ink jet dye) tend to be susceptible to fluorescence over multiple excitation wavelengths. What is more, subtle variation in the chemistry of the ink used for the variable indicia may greatly alter its fluorescence characteristics, inadvertently causing emissions to occur with excitation wavelengths and fluorescence emission wavelengths previously thought to be secure. Given that the bandwidth of possible excitation and emission wavelengths is so large and the nature of fluorescence attacks allow for timed exposures over a narrow (i.e., fluorescence emission) bandwidth, it is extremely difficult to engineer reliable opacity blocking layers sufficient to ensure security over a large press run. The underlying problem is that timed exposures over a filtered narrow band centered about the fluorescence emission wavelength of the variable indicia allows for extremely small emissions of photons from the variable indicia fluorescence transmitted through the upper security layers to be collected over time, thereby allowing for a sufficient S/N ratio to identify the variable indicia of a document with the SOC intact.

Figure 3:
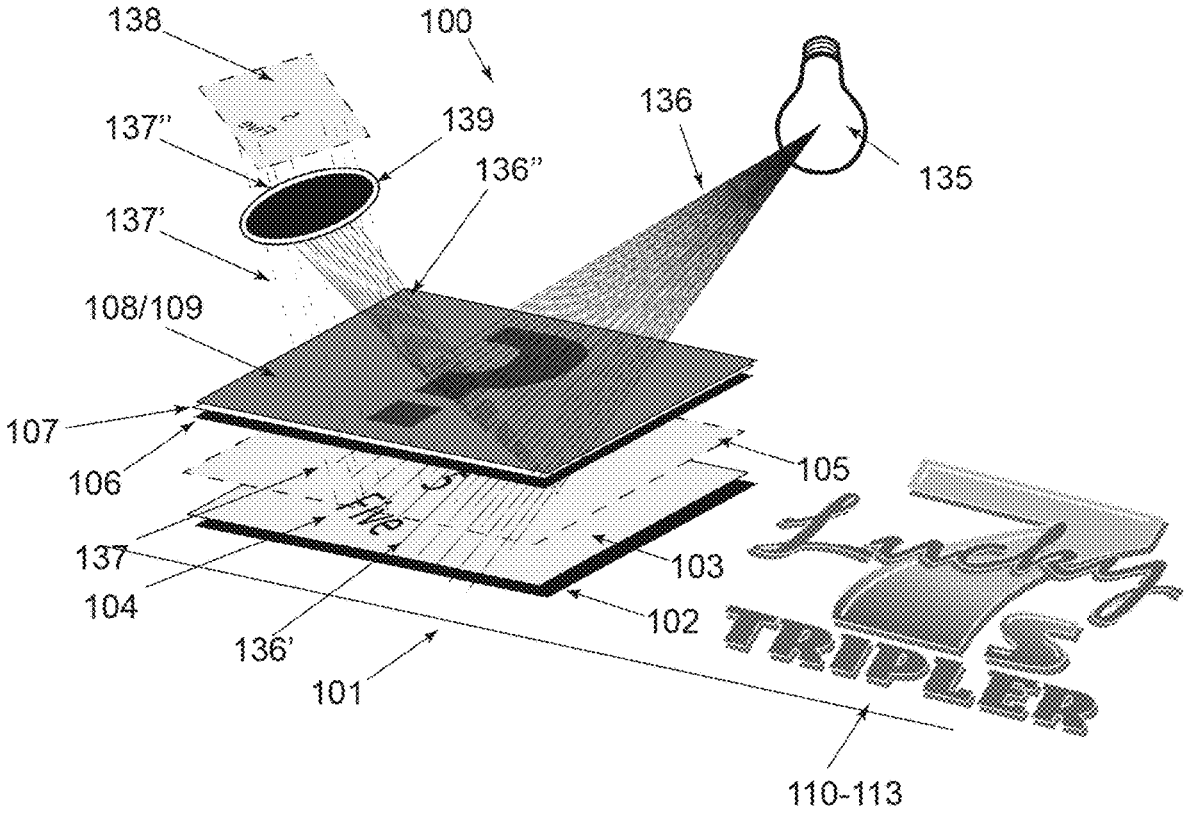
FIG. 3 is a partially exploded top isometric view of the traditional lottery-type instant ticket security ink film stack of FIG. 1 under a fluorescence attack through the overprint layers.

For example, FIG. 3 illustrates one possible method to induce sufficient fluorescence in the variable indicia 104 of a traditional document or ticket 100 secured under SOC security layers 105 through 107 and the overprint layers 108 and 109 to ascertain the variable indicia information without damaging the SOC. In FIG. 3, an excitation light source 135 generates excitation photons of a desired wavelength 136 (e.g., $\lambda$=488 nm—blue light) of sufficient quantity and intensity to penetrate, albeit with attenuated photons 136', the upper blocking SOC security layers 105 through 107) and overprint areas 108 and 109, thereby inducing fluorescence 137 in the traditional ink jet dye-based variable indicia 104. Since the induced ink jet variable indicia fluorescence 137 is of a different and longer wavelength (e.g., $\lambda$>850 nm—Infrared (IR) light), the lesser number of fluorescence photons 137' that penetrate through the SOC security layers 105 through 107 and overprint areas 108 and 109 to radiate from the ticket or document's surface provide a large enough S/N ratio sufficient to produce an image 138 of the previously hidden variable indicia 104, using a timed exposure camera where an optical filter 139 blocks the reflected excitation light source 136", only allowing the longer wavelength fluorescent light 137" to pass.

All of these previous types of attacks (i.e., diffusion, electrostatic, and fluorescence) exploit the different types or chemistries of ink and application techniques of the variable indicia 104 (typically ink jet dye) relative to the rest of the type or types of ink used (typically fixed plate applied ink) in the document or lottery ticket 100 to obtain sufficient S/N to ascertain the variable indicia without removing the SOC. However, any differences between the application and materials of the variable indicia and the display areas or overprint areas of a document or ticket are completely eliminated with the invention of utilizing the same variable digital imager and ink to print both the variable indicia and the overprint areas or the display areas, or all of the variable indicia and the overprint areas and the display areas. Imaging the SOC overprints and possibly the ticket back with identical imager techniques or materials can further enhance this commonality. Thus, by utilizing common, (also called homogenous) applications and materials over the entire document or ticket as well as the variable indicia eliminates any attempt to garner a positive S/N ratio of the variable indicia ink relative to the rest of the document's background ink noise by exploiting unique physical characteristics of the variable indicia.

Figure 4:
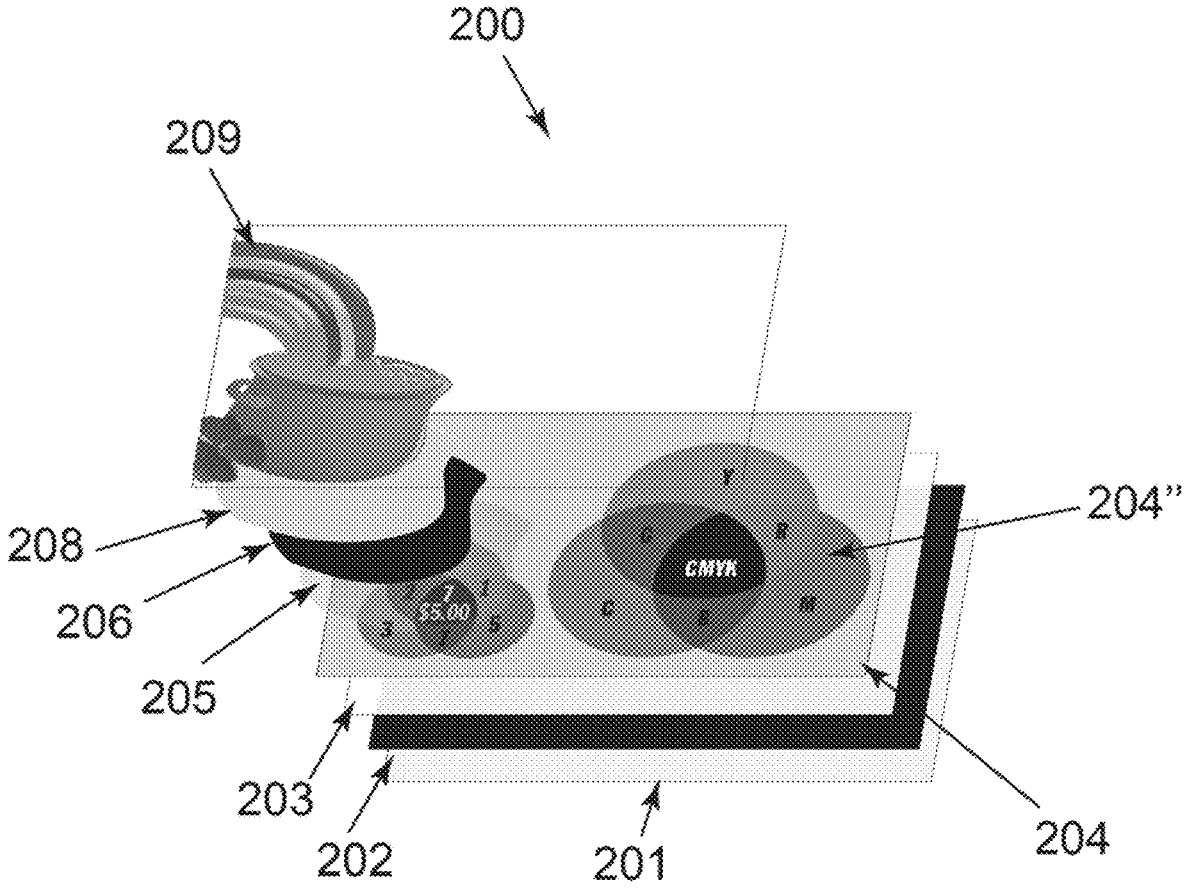
FIG. 4 is an exploded top isometric view of a first representative example of a modified lottery-type instant ticket security ink film stack utilizing variable indicia homogenized with the ticket display area and overprint area according to the present invention.

FIG. 4 provides a preferred embodiment of an exploded top isometric view of a modified document with secure variable indicia according to the present invention, in the form of an exemplary lottery-type instant ticket 200. The ticket includes a substrate 201 having lower security ink film stack layers 202 and 203 below the printed layer 204 with the variable indicia 204' and the overprint areas 205 through 209 utilizing variable indicia homogenized with the ticket display areas and overprint areas. The embodiment of FIG. 4 illustrates the variable indicia 204' and ticket display 204" are printed as part of the same homogenous digital imager application on printed layer 204 on the lottery-type instant ticket 200. For the purposes of this embodiment, the type of digital imager ink or material (e.g., toner based, thermal transfer, pigmented ink jet, dye based ink jet, etc.) and the method or technique of applying the homogenous variable indicia and display film layer 204 to the ticket 200 is irrelevant; the significant concept is that the variable indicia 204' and display area 204" are to be applied with the same application utilizing the same printing inks or dyes, whatever they are. Since the resulting homogenous film 204 covers both the variable indicia and the display area there can no longer be any positive S/N ratio derived from differences between the variable indicia 204' and the display area 204". Therefore, the underlying concept of diffusion, electrostatics, and fluorescence exploiting a positive S/N ratio of the variable indicia ink relative to the ticket background ink noise is no longer applicable. In other words, any attempt to extract any unique characteristic of the variable indicia will also extract the same characteristic from the display area noise with no positive S/N possible. This reduction of variable indicia 204' signal relative to the ticket 200 background noise can be further enhanced by imaging the overprint area 209 with the same digital imaging process that was used to generate the variable indicia 204' and the display area 204" into a homogenized film layer 204.

As its name implies, the overprint 209 is printed after the variable indicia on top of SOC layers 205, 206, and 208 and therefore cannot be imaged at the same time as the variable indicia 204'. However, by digitally imaging the overprint 209 with the same process and materials as the variable indicia 204', the same effect of eliminating any variable indicia signal to the remainder of the ticket 200 ink noise is achieved especially for attacks (e.g., fluorescence) that attempt to penetrate the SOC.

In an alternative embodiment, the display area 204" can be imaged with the same application as the overprint area 209, providing a homogeneous film encompassing the overprint area 209 and the display area 204" with the variable indicia 204' being imaged with the same process and materials, thereby ensuring no significant variable indicia 204' signal relative to the background noise of the ticket's display 204 area" and the overprint area 209. In certain applications this alternative embodiment may be preferred where it is desirable to ensure that the overprint area 209 graphics and display area 204" seamlessly blend together and may therefore provide a countermeasure to unassisted and assisted SOC lifting techniques where the SOC is temporally "lifted" by mechanical means, which allow for the underlying variable indicia to be observed, and then the SOC rolled back into position with an adhesive, thereby making the ticket appear uncompromised. This alternative embodiment would provide a countermeasure to these unassisted and assisted SOC mechanical lift attacks by eliminating any clear demarcation between the overprint area 209 and display area 204" with any mechanical lift attempt disrupting the homogenous overprint area 209 and display area 204". This disruption in image effect can be enhanced by including fine lines and/or other micro-printing around the boundary between the overprint area 209 and display area 204".

Returning to the homogeneous unified film variable indicia 204' and display area 204" embodiment of FIG. 4, as shown in the figure, the configuration of the remaining ink security stack protecting the variable indicia 204' can remain essentially the same as in the existing ticket 100 described in FIG. 1. With the ticket 200 of FIG. 4, the entire ink film stack is deposited on a paper, foil, or other substrate 201 and the lower security-ink film opacity layers 202 and a higher contrast (e.g., white or gray) background layer 203 such that a human consumer can read the variable indicia 204' are used. The upper security ink film layers also isolate the variable indicia 204', first with a release coating 205 that helps seal the variable indicia to the substrate and also causes any ink films printed on top of it to scratch-off. Next, at least one upper opacity layer 206 is applied to help protect against candling and fluorescence attacks. On top of the opacity layer(s), at least one white ink film 208 is typically applied that provides a higher contrast background for overprint inks with the overprint area 209 imaged both as an attractive appearance of the SOC area as well as possibly providing additional security.

As illustrated in the embodiment of ticket 200 shown in FIG. 4, the lower security opacity layer 202 and higher contrast background layer 203, either or both included within the back or bottom printed portion are not confined just to the variable indicia area 204, but rather flood the entire ticket 200 substrate 201 from edge to edge. This flooding of the entire ticket 200 substrate 201 area allows for generic lower security printing plates or cylinders for any type of ticket design to be maintained from print run to print run. Thus, there would be no need to change the fixed printing plates or cylinders (e.g., flexographic, gravure, etc.) between printing different games. As is practiced in the existing art, these lower security areas are always customized to only cover the general variable indicia scratch-off area 204' and not to flood the entire ticket—see lower security layers 102 and 103 of ticket 100 of FIG. 1. This is primarily because the higher contrast background layer(s) 203 are not sufficiently opaque to provide a completely neutral (i.e., white) background over the black opacity layer 202. Additionally, it is sometimes argued that the cost of inks for the lower security areas can be reduced by confining the lower security ink coverage to only the variable indicia scratch-off area(s).

The embodiment of ticket 200 of FIG. 4 overcomes the neutral background limitation by simply applying at least one thicker or denser or thicker and denser higher contrast background 203 layer to the substrate. This thicker and/or denser ink film deposit higher contrast background layer 203 becomes possible once it is realized that a generic flood coverage of the ticket 200 surface allows for more ink 203 to be applied to the substrate 201 than would normally be possible, since there is no longer any requirement to print lines or hold registration to a predefined demarcated area. Thus, for flexographic applications, the lower security ink films can be applied via anilox rollers with very low line screens and high Billion Cubic Microns (BCM) capacity, the only limiting factor being the ability to cure the ink film at press speeds. Additionally, since it is envisioned that the lower security ink film layers 202 and 203 of ticket 200 are not changed between print runs, it may become economically feasible to use printing technologies with a high cost of printing cylinder creation, but also a high potential capacity to deposit thick and/or dense ink films—e.g., gravure. The higher costs of ink coverage as well as the higher costs of printing cylinder production are more than compensated for by the reduced time and expense associated with reconfiguring a press from one print run to the next.

In another alternative embodiment, the upper blocking layer(s) 206 and white film layer(s) 208 could be configured for flood coverage similar to the lower security layers 202 and 203 of ticket 200 with even more reduction in press setup costs. However, the release layer 205 in all embodiments would be confined to the variable indicia scratch-off area 204' to ensure that only the desired SOC areas of the ticket 200 scratch-off.

In addition to flood coverage, in yet another embodiment it may be possible to eliminate the lower security layers 202 and 203 entirely. In this embodiment, the nature of digital full-color imaging utilized for the variable indicia 204' offers the potential to eliminate lower security layers 202 and 203, since the imaged variable indicia 204' is deposited as a continuous film 204, preferably as part of the ticket display area 204" and therefore, has a lower S/N ratio, since no special materials are utilized for the variable indicia.

In still another embodiment, the security layers of the ticket 200 may be applied via a digital imager. In this embodiment, the opacity layers 202 and 206 and white high contrast overprint areas or layers 203 and 208 would be ink jet imaged in the shape of the variable indicia scratch-off area, preferably with an Ultraviolet (UV) curing system. The UV curing system is preferred because direct energy curing typically leaves a thicker, more robust ink film deposit on the substrate utilizing direct energy curing, rather than convection curing.

Figure 5:
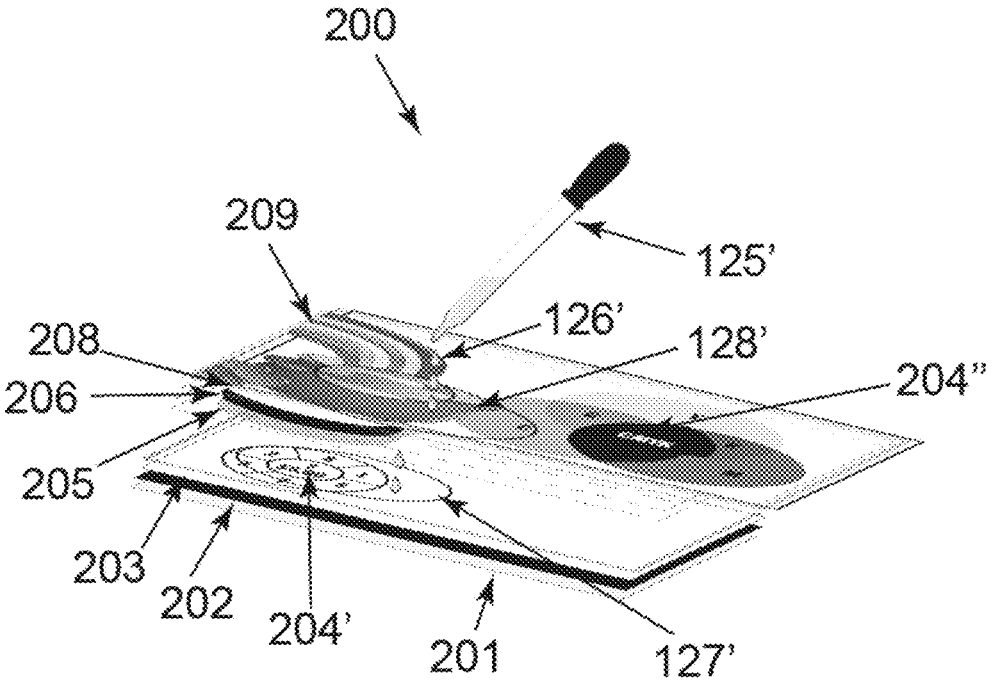
FIG. 5 is a partially exploded top isometric view of the modified lottery-type instant ticket security ink film stack of FIG. 4 utilizing variable indicia homogenized with the ticket variable indicia and overprint under a diffusion attack through the overprint layers.

When the homogenized embodiments of the ticket 200 of FIG. 4 and its alternatives are subjected to diffusion attack, no appreciable S/N ratio of the ticket variable indicia 204' relative to the ticket background ink noise can be discerned. For example, FIG. 5 depicts the ticket 200 under a diffusion attack similar to FIG. 2, where the eyedropper 125' applies solvent 126' selected to attack the ink of the variable indicia 204'. However, in FIG. 5, the area 127' where the solvent 126' is applied simultaneously attacks both the overprint area 209, as well as the variable indicia 204', resulting in a combined surface area 128' that dissolves and combines both the overprint area 209 and variable indicia 204'. This results in a blurred image that does not carry a sufficient S/N ratio of the variable indicia ink relative to the overprint area ink to discern the variable indicia. Additionally, by having the surface display area 209 printed in the same application and materials as the variable indicia 204' any solvent sufficiently powerful to draw the variable indicia through the upper security layers 205, 206, and 208 would also irrevocably alter the display area 209, such that the tampering by diffusion would be readily apparent and the ticket could no longer be sold as pristine.

Figure 6:
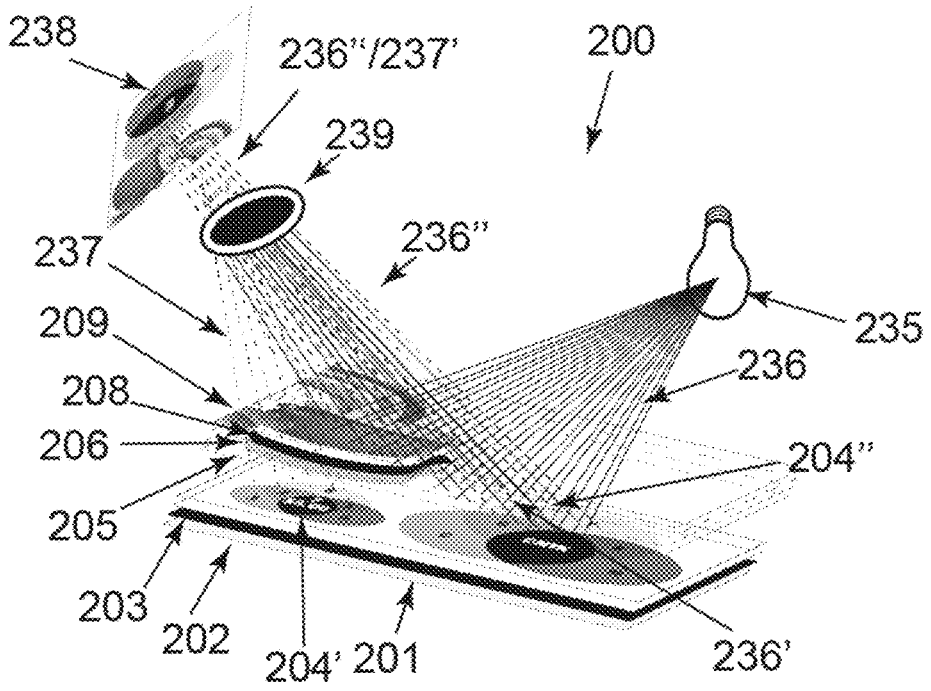
FIG. 6 is a partially exploded top isometric view of the modified lottery-type instant ticket security ink film stack of FIG. 4 utilizing variable indicia homogenized with the ticket display and overprint under a fluorescence attack through the overprint layers.

The same principle applies when the homogenized embodiments of the ticket 200 of FIG. 4 are subjected to a fluorescence attack—i.e., no appreciable S/N ratio of the ticket variable indicia 204' relative to the ticket background can be discerned. For example, FIG. 6 depicts the ticket 200 under a fluorescence attack similar to FIG. 3 where an excitation light source 235 attempts to project sufficient photons of the correct excitation wavelength 236 to induce fluorescence photons 237 in the variable indicia 204' and after attenuation, photons 236 through the upper security layers and display area of the ink stack (205, 206, 208, and 209). However, in FIG. 6 the fluorescence 236"/237' from the overprint area 209 and the display 204" completely saturate any fluorescence induced photons from the variable indicia 237, resulting in a time exposure image that does not carry a sufficient S/N ratio of the variable indicia relative to the overprint area and/or the display area noise to discern the variable indicia. Again, the common shared application and materials of the variable indicia 204' with the display area 204" and the overprint area 209 results in a homogenous ticket 200 where the variable indicia cannot be picked-out due to insufficient S/N ratio.

In many, if not most instances in this invention, the homogenous integration of ink used in the variable indicia with the other printed portions of the document will be the identical ink, so that the S/N ratio of the ink used for the variable indicia will be the same as the background ink noise of the other printed portions. Typically, such inks may be any of a dye based ink, a pigment based ink or inks having other bases. Also in this invention, the inks of the variable indicia and the other portions can be applied using the same printing technique, such as ink jet printing, thermal transfer or xerography, for instance, for the same reason. However, it is important to understand that the identical ink chemistry need not be used and the identical printing technique need not be used for the variable indicia and the other printed portions of the document. Rather, what is important is that the inks and printing techniques used result in the variable indicia having a S/N ratio relative to the background ink noise of the document's at least one other printed portion, such that the variable indicia are unreadable with reference to the at least one other printed portion when the SOC remains intact. The S/N ratio need not be exactly zero, so long as the variable indicia cannot be read or otherwise discerned in view of or with reference to the background noise of at least one other printed portion of the document when the SOC is intact.

The invention also includes any method or system for making a secure document as described above. Thus, the method broadly comprises printing the variable indicia comprising ink having a S/N ratio relative to the background ink noise of the document's at least one other printed portion, such that the variable indicia are unreadable with reference to the at least one other printed portion when the scratch-off-coating remains intact.

Various types of printing presses and combinations of printing presses are available to make the secure document of the invention and according to the method of the invention.

Figure 7:
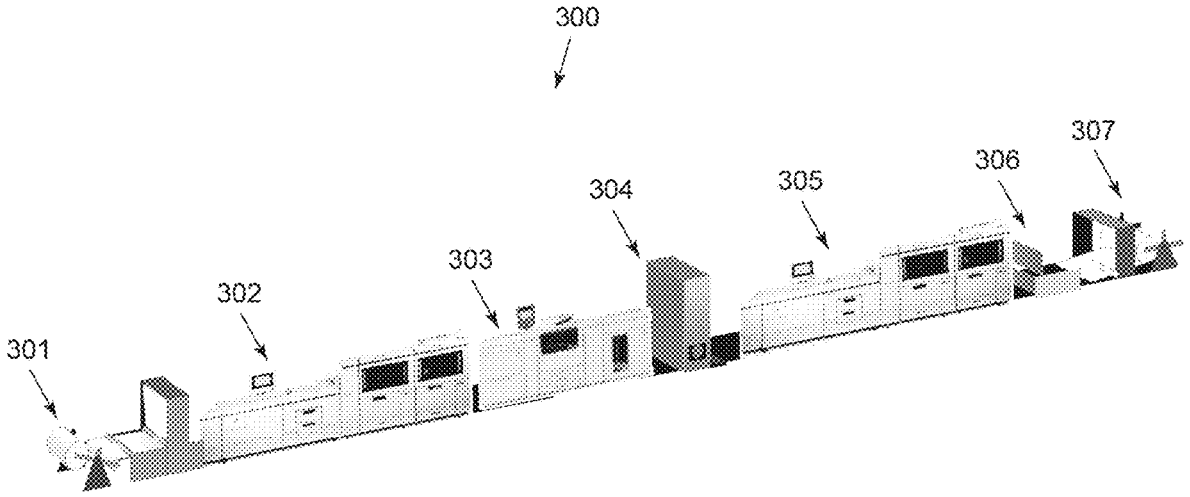
FIG. 7 is a schematic view of a first representative example of a digital press configuration capable of printing the modified lottery-type instant ticket security ink film stack of FIG. 4.

FIG. 7 illustrates one embodiment of a printing press 300 capable of producing tickets 200 with homogenous integration of the variable indicia 204', the display area 204", the overprint area 209, and/or the ticket back printing area (not shown). As shown in the embodiment of FIG. 7, paper is fed into the press on a spool 301 to a seven-color digital imaging unit 302. The seven-color unit 302 images a Lower Blocking Black (LBB) ink film layer 202 and two white high contrast overprint ink film layers 203 in the shape of the variable indicia scratch-off area, preferably with an UV based curing system. After the lower security LBB ink film layer 202 and the white high contrast ink film layers 203 are applied, a four-color process digital image is applied to image both the ticket variable indicia 204' and display area 204". Thus, the printed ticket will have a homogenized variable indicia 204' and display area 204". After printing the front variable indicia 204' and display area 204", the substrate 201 is flipped and the ticket back is imaged as a four-color process by a unit 303 with application and materials identical to that applied by the unit 302. After the ticket back is printed, the substrate is flipped again and a release coat 205 is flexographic printed at a station 304 over the variable indicia 204' to provide protection for the variable indicia as well as to ensure that any subsequent ink films deposited on the release coat 205 will scratch-off. Ideally, the release coat 205 is also direct energy cured with either UV or an electron beam. After the release coat is applied, a second seven-color unit 305 images an Upper Blocking Black (UBB) ink film layer 206 and two white high contrast overprint ink film layers 208 in the shape of the variable indicia scratch-off area preferably with an UV curing system. After the upper security UBB ink film layer 206 and white high contrast 208 ink film layers are applied, a four-color process digital image is applied to image the overprint area(s) 209. Once the upper security layers 206 and 208 and overprint area 209 have been imaged, periodic perforations are stamped into the substrate by a unit 306 to allow strips of tickets to be packaged and torn off individually at the time of sale. The resulting fully imaged and perforated substrate is then collected via a take-up reel or fan-folder 307. The embodiment of FIG. 7 has the advantage of rapid and low cost setups between press runs with the flexographic plate of the release coat at the station 304 being the only station that requires manual intervention.

Figure 8:
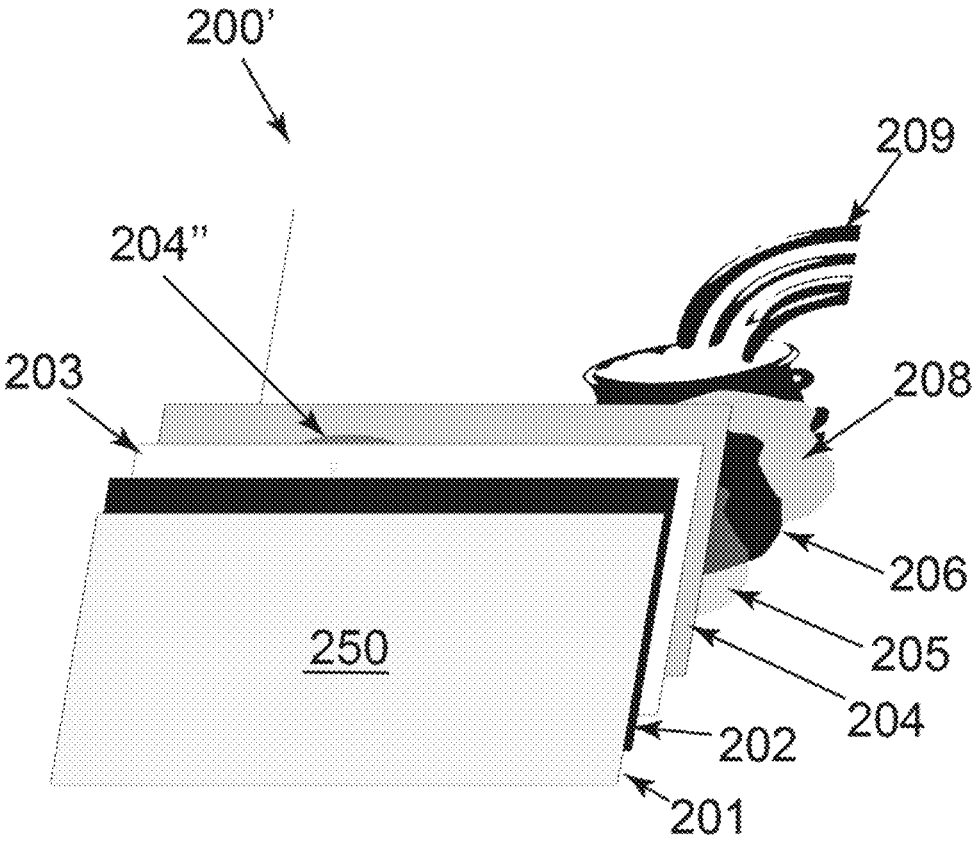
FIG. 8 is an exploded bottom isometric view of FIG. 4.

FIG. 8 is an exploded bottom isometric view of FIG. 4. FIG. 8 shows ticket back 250 (also, referred to as "document backing" or "back of the document") comprising at least one back printing area. The remaining elements and their respective element numbers in FIG. 8 are identical to those shown in FIG. 4, except viewed from the bottom.

Of course, there are other variations of the preferred embodiment printing press (e.g., all upper security layers being printed by individual flexographic stations, ticket back printed with flexographic or offset station or monochromatic imager, lower security layers being accommodated via the paper stock, etc.) that are would be apparent to anyone skilled in the art in view of this disclosure.

What is claimed is:

1. A security-enhanced document comprising:

a substrate having a first side;

a first security layer comprising an opaque layer printed on the entire first side of the substrate;

a second security layer having a higher contrast than the first security layer and printed on the entire first security layer;

variable indicia printed on part but not all of the second security layer using a first printing technique, the variable indicia comprising a first pigmented ink jet process color ink;

a scratch-off-coating applied over the variable indicia; and an other printed portion comprising a second pigmented inkjet process color ink having an identical chemical formulation as the first pigmented inkjet process color ink and printed using a second printing technique that is identical to the first printing technique, the other printed portion including a first area and a second area, wherein the first area of the other printed portion is on top of the scratch-off coating and on top of the variable indicia, and wherein the second area of the other printed portion is not on top of the variable indicia, wherein the second area of the other printed portion is on the second security layer, and wherein the second area of the other printed portion comprises a display area, and wherein the variable indicia and the second area of the other printed portion comprise a homogenous film on the second security layer.

2. The document of claim 1, wherein the security-enhanced document is an instant lottery ticket.

3. The document of claim 1, wherein the other printed portion comprises at least one decorative portion of an overprint area on top of the scratch-off coating.

4. The document of claim 1, wherein the other printed portion further comprises at least one back printing area.

5. A method for generating a security-enhanced document comprising a substrate having a first side, a first security layer comprising an opaque layer printed on the entire first side of the substrate, a second security layer having a higher contrast than the first security layer and printed on the entire first security layer, variable indicia printed on part but not all of the second security layer using a first printing technique, the variable indicia comprising a first pigmented ink jet process color ink, a scratch-off-coating applied over the variable indicia, and an other printed portion comprising a second pigmented inkjet process color ink having an identical chemical formulation as the first pigmented inkjet process color ink and printed using a second printing technique that is identical to the first printing technique, the other printed portion including a first area on top of the scratch-off-coating, and a second area, wherein the first area of the other printed portion is on top of the scratch-off coating and is on top of the variable indicia, and wherein the second area of the other printed portion is not on top of the variable indicia, the method comprising:

printing the first security layer on the entire first side of the substrate;

printing the second security layer on the entire first security layer;

printing the variable indicia comprising the first pigmented ink jet process color ink on part but not all of the second security layer;

applying the scratch-off-coating on top of the variable indicia; and printing the first area of the other printed portion on top of the scratch off coating, such that the second area of the other printed portion is on the second security layer, the second area of the other printed portion comprises a display area, and the variable indicia and the second area of the other printed portion comprise a homogenous film on the second security layer.

6. The method of claim 5, wherein the security-enhanced document is an instant lottery ticket.

* * * * *